United States Patent [19]

Jackson

[11] 3,992,144

[45] Nov. 16, 1976

[54] MIGRATION-FREE TEXTILE DRYING

[75] Inventor: Harold L. Jackson, Hockessin, Del.

[73] Assignee: E. I. Du Pont de Nemours and Company, Wilmington, Del.

[22] Filed: May 28, 1975

[21] Appl. No.: 581,561

[52] U.S. Cl. ..... 8/174; 8/179; 8/94 A

[51] Int. Cl.[2] ..... D06P 1/68

[58] Field of Search ..... 8/174, 94

[56] References Cited

UNITED STATES PATENTS 3,762,872 10/1973 Acree ..... 8/176

FOREIGN PATENTS OR APPLICATIONS 760,243 12/1970 Belgium
2,161,733 6/1973 Germany
2,002,286 7/1971 Germany

OTHER PUBLICATIONS

Capponi, et al., American Dyestuff Reporter, 1974, (Jan.), pp. 36–47.

*Primary Examiner*—Joseph L. Schofer
*Assistant Examiner*—A. L. Clingman

[57] ABSTRACT

Textile drying process comprising continuously contacting a moving textile web, which is wet with a first fluorocarbon liquid having a textile agent dispersed therein, with the superheated vapors of a second fluorocarbon liquid, the superheated vapors being at a temperature such that no substantial amount of second fluorocarbon liquid condenses on the web, to evaporate substantially all of the first fluorocarbon liquid from the web in no more than seven seconds without causing substantial migration of the textile agent on the web, said first and second fluorocarbon liquids being selected from fluoro and chlorofluoro substituted aliphatic and cycloaliphatic hydrocarbons, ethers and tert.-amines wherein the ratio of hydrogen atoms to halogen atoms is 0 – 0.2, the first fluorocarbon liquid having a boiling point of 20° – 110° C. and the second fluorocarbon liquid having a boiling point of 20° – 220° C.

19 Claims, No Drawings

MIGRATION-FREE TEXTILE DRYING

BACKGROUND OF THE INVENTION

1. Field of the Invention

This invention relates to a process for drying a moving textile web which is wet with a fluorocarbon liquid having dispersed therein a textile agent.

2. Description of the Prior Art

German Pat. No. 2,002,286 discloses the padding of a textile material with a solution or suspension of a dye in a liquid of the formula R-F wherein R is a radical of the formula $FCl_2C—CFCl—$, $Cl_3C—$, $Cl_2HC—$ or $F_2ClC—CFCl—$. Thereafter, the textile material is dried, for example, by drawing air through it, and the dye is fixed by conventional fixation methods. Belgian Pat. No. 760,243 discloses a continuous process for drying and fixing a moving textile material which is padded with a solution or a dispersion of colorant in an organic solvent which forms vapors heavier than air. Solvent vapors obtained by evaporation from the web are superheated and returned to contact the textile material so as to evaporate the solvent from the material. U.S. Pat. No. 3,542,506 discloses squeeze roll expression from a textile web of dye liquor comprising a liquid vehicle, such as trichlorotrifluoroethane, followed by countercurrent application of superheated steam, to evaporate the vehicle and sweep resultant vapors from the web, and recovery of the vehicle by decantation of the condensed mixture of steam and vapors of the vehicle. Junginger in Verfahrenstechnik 4 (1970) No. 2, 66–73 discloses that migration of dissolved substances in textile wetting liquids is maximum at a drying rate of about 10 kg./meter$^2$/hour; various drying means are disclosed. Gerber in Melliand Textilberichte [English Edition], March, 1972, p. 283 et seq. (Melliand Textilberichte, March, 1972, p. 336 et seq.) discusses the problem of dye migration during intermediate drying and notes that it should be possible to prevent migration by shock drying but that the necessary evaporation rates of over 100 kg./meter$^2$/hour cannot be obtained with conventional convection dryers. Organic solvents, such as tetrachloroethylene, are suggested as offering an advantage in this respect. Lehmann et al. in Textil-Praxis Internat. 28:52–54, 53 (1973) disclose that although the evaporation rate of perchloroethylene is ten to eleven times greater than that of water, which puts it into the range of an evaporation capacity of 100 kg./meter$^2$/hour, theoretical considerations and experiments have demonstrated that migration using perchloroethylene as a dyeing medium is much greater than when water is used. Finally, Capponi et al. in American Dyestuff Reporter, January, 1974, page 47, in a discussion of continuous dyeing with solvents, disclose that migration during dyeing must be controlled by mechanical engineering methods and that evaporation of the solvent must not take place too quickly so that migration can largely be prevented.

DETAILED DESCRIPTION OF THE INVENTION

This invention is directed to a continuous process for drying a moving textile web which is wet with a fluorocarbon wetting liquid having dispersed therein a textile agent, which process substantially avoids migration of the agent on the web. More specifically, the process comprises passing superheated vapors of a fluorocarbon stripping liquid having a boiling point 20° – 220° C. over or through a moving textile web which is wet with a fluorocarbon wetting liquid having a boiling point of 20° – 110° C. and having dispersed therein a textile agent. The process is carried out so that substantially all of the wetting liquid is evaporated in no more than seven seconds, and preferably in no more than three seconds, without condensation of any substantial amount of stripping liquid on the web. Thus, the substantially even distribution of the textile agent in the dispersion is undisturbed by migration during the evaporation. Achievement of these time limits is controlled by the nature of the fluorocarbon wetting liquid and the nature of the fluorocarbon stripping liquid, the temperatures of the wetting liquid and the stripping liquid vapors and the speed of movement of the textile web. Through the use of the process of this invention, volatile wetting liquids containing textile agents dispersed therein are evaporated from the web without any substantial migration of the agent on the web, thereby avoiding the frequently vexing problem of textile agent unlevelness resulting from migration of the agent during drying of the textile web. The invention process is particularly advantageous in continuous dyeing operations wherein control of dye migration is essential to achievement of level dyeings.

As the term is used herein, "textile web" is intended to mean any manufacture from fibers or filaments, natural or synthetic, to which a textile agent is applied. The textile web may be in the form of fabric (knitted, woven or nonwoven), carpeting (woven, tufted, knitted or nonwoven) or yarns (which may be in the form of hanks, bundles or skeins which may be supported on a foraminous band such as a stainless steel mesh belt). The chemical composition of the textile web is immaterial so long as it is normally treatable with the textile agent. Substantially all natural and synthetic textile polymers are operable, such as polyacrylics, including modacrylics, polyesters, polyamides, cellulose acetates, such as cellulose diacetate and cellulose triacetate, regenerated cellulose, such as the rayons, and cotton, wool and silk.

The web which is to be dried in the invention process is wetted with a fluorocarbon wetting liquid (as hereinafter defined) having dispersed therein one or more textile agents. Usually, the wetting has been achieved by a continuous, textile wet-processing method, such as spraying or padding, with or without subsequent passage between squeeze rolls. Padding may involve immersion, doctoring, contact with a kiss-roll or other means practiced in the textile industry. The amount of fluorocarbon wetting liquid present on the textile web may vary according to the process by which it was applied and the construction of the textile web. For example, lightweight woven fabrics which have been padded and passed between squeeze rolls or over a vacuum slot may contain as little as about 40–50%, based on the weight of the dry fabric, of fluorocarbon wetting liquid, whereas bulky knitted fabrics and carpeting may contain about 120–200%, based on the weight of the dry fabric, or even higher, depending on their construction. Generally, the moving textile web will contain 50–200% of fluorocarbon wetting liquid.

The wetting liquids are fluorocarbons selected from fluoro and chlorofluoro substituted aliphatic and cycloaliphatic hydrocarbons, ethers and tert.-amines having a boiling point of 20°–110° C. and wherein the ratio of hydrogen atoms to halogen atoms is 0–0.2. The term "boiling point" as used herein refers to the normal boiling point of the liquid under ambient conditions of one atmosphere of pressure at sea level. The wetting liquids which are employed herein require little heat to effect ebullition and evaporation because they have a low specific heat of about 0.2 cal./gram, a latent heat of vaporization at the boiling point of less than about 50 cal./gram and a boiling point of 20°–110° C. Thus, evaporation from the textile web can be effected sufficiently rapidly that there is no substantial migration of the textile agent. Preferably, the boiling point of the fluorocarbon wetting liquid is 20°–50° C. Among such wetting liquids, chlorofluoro substituted aliphatic hydrocarbons are preferred, with trichlorofluoromethane and 1,1,2-trichloro-1,2,2-trifluoroethane being most preferred. Of the fluoro substituted compounds, perfluorodimethylcyclobutane is preferred. Table 1 provides a list of liquids and, for each liquid, the boiling point, heat of vaporization (Hv) at the boiling point and heat required to bring the liquid from 20° C. to its boiling point and then completely vaporize it. Liquids 1–17 are useful wetting liquids herein. Liquids 18–21 are not useful wetting liquids in the invention process because they require excessive energy to bring them to their boiling points and to evaporate them.

TABLE 1

| No. | Liquids | b.p. (° C.) | Hv* (cal./gram) | Heat* (cal./gram) |
|---|---|---|---|---|
| 1 | Perfluorodimethylcyclohexane | 102 | 19 | 36 |
| 2 | Perfluorodimethylcyclobutane | 43 | 21 | 26 |
| 3 | Perfluorohexane | 57 | 20 | 28 |
| 4 | Perfluoro(N-propylmorpholine) | 98 | 19 | 35 |
| 5 | Perfluoro(2-propyltetrahydropyran) | 100 | 18 | 35 |
| 6 | $CF_3CF_2CF_2OCF_2CF_3$ | 39 | 21 | 25 |
| 7 | $CF_3CF_2CF_2OCHFCF_3$ | 39 | 21 | 25 |
| 8 | Trichlorofluoromethane | 24 | 44 | 45 |
| 9 | 1,1,2-Trichloroperfluorocyclobutane | 94 | 23 | 39 |
| 10 | 2,2-Dichloroperfluoropropane | 33 | 25 | 28 |
| 11 | 1,2-Dichloroperfluoropropane | 33 | 25 | 28 |
| 12 | 1,1,2-Trichloro-1,2,2-trifluoroethane | 48 | 35 | 41 |
| 13 | 2,3-Dichloroperfluorobutane | 63 | 25 | 34 |
| 14 | $CF_2ClCHClF$ | 28 | 41 | 43 |
| 15 | $CF_3CHCl_2$ | 29 | 41 | 43 |
| 16 | $F[CF(CF_3)CF_2O]_2CHFCF_3$ | 104 | 17 | 36 |
| 17 | $F[CF(CF_3)CF_2O]_2CF_2CF_3$ | 102 | 16 | 33 |
| 18 | Methylene Chloride | 40 | 79 | 84 |
| 19 | Tetrachloroethylene | 121 | 55 | 75 |
| 20 | Trichloroethylene | 87 | 57 | 72 |
| 21 | Carbon Tetrachloride | 77 | 52 | 63 |

*Values are calculated for liquids 1–17; Trouton constant ≅ 20.2; specific heat ≅ 0.21 cal./g.

The wetting liquid of the process of this invention can be a single fluorocarbon or a mixture of fluorocarbons, as defined above. Constant boiling fluorocarbon azeotropes also can be used provided the fluorocarbon is the major component of the azeotrope. Examples of such useful constant boiling azeotropes include $CF_2ClCFCl_2/C_2H_5OH$ (4% by wt. $C_2H_5OH$), $CF_2ClCFCl_2/(CH_3)_2CO$ (11.6% by wt. acetone), $CF_2ClCFCl_2/CH_2Cl_2$ (49.9% by wt. $CH_2Cl_2$) and $CF_2ClCFCl_2/CH_3NO_2$ (2.9% by wt. $CH_3NO_2$). Minor amounts of other materials which do not adversely affect the above-mentioned properties of the wetting liquids can be present therewith. Examples of such materials include dispersants, assistant solvents, agent dispersant vehicles and adjuvants, for example, which prevent bacterial degradation.

The textile agent which is dispersed in the fluorocarbon wetting liquid is a compound, or mixture of compounds, which is conventionally applied to a textile to achieve a desired property. Such agents include dyes and pigments, water repellents, permanent-press agents, soil release agents, ultraviolet light screening agents, fluorescent brightening agents, flameproofing or fire retardant agents, antistatic agents, bacteriostats and fungicides. Useful dyes can be selected from any application class and include disperse dyes, acid dyes and basic dyes. Table 2 includes operable dyes which are classified by chemical composition. Table 3 includes representative examples of some operable classes of textile agents other than dyes.

TABLE 2

| | |
|---|---|
| Azo | |
| 3-[N-Methyl-p-(p-nitrophenylazo)-anilino] propionitrile | (orange) |
| 5'-[Bis(2-hydroxyethyl)amino]-2'-(2-chloro-4-nitrophenyl-azo)benzanilide, diacetate ester | (red) |
| p-[4-(o-Tolylazo)-o-tolylazo]phenol | (orange) |
| 3,3'-[p-(2-Chloro-4-nitrophenylazo)-phenylimino]-dipropionitrile | (orange) |
| 3-[4-(2,6-Dichloro-4-nitrophenylazo)-N-ethyl-m-toluidino]propionitrile | (brown) |
| Anthraquinone | |
| 1-Anilino-4,5-dihydroxy-8-nitroanthraquinone | |
| 1,8-Dianilino-4,5-dihydroxyanthraquinone | (blue) |
| 1,4-Diamino-2,3-dichloroanthraquinone | (violet) |
| 1-Amino-4-hydroxy-2-(2-methoxyethoxy)-anthraquinone | (red) |
| 4'-(4-Hydroxy-1-anthraquinonylamino)-acetanilide | (blue) |
| Aminonaphthalimide | |
| 4-Amino-N-(2,4-xylyl)naphthalimide | (yellow) |
| 6-Methoxy-N-(p-methoxyphenyl)-1-nitrobenzo-[kl]thioxanthene-3,4-dicarboximide | (red) |
| Methine | |
| p-[Butyl(2-chloroethyl)amino]-α-cyanocinnamic acid, ethyl ester | (yellow) |
| α-Cyano-p-(N-methyl-p-phenetidino)-cinnamic acid, ethyl ester | (yellow) |
| 4-[Ethyl(2-hydroxy-3-phenoxypropyl)amino]-2-methyl-benzylidene malononitrile, carbanilate ester | (yellow) |
| Aminoketone | |
| N-[p-(Benzyloxy)phenyl]-2,5-cyclohexadiene-1,4-diimine | (green) |
| Diphenylamine | |
| N-(2,4-Dinitrophenyl)-p-phenylenediamine | (yellow) |
| 4-Chloro-4'-methoxy-2-nitrodiphenylamine | (orange) |
| 3-Nitro-N⁴-phenylsulfanilanilide | (yellow) |
| Quinophthalone | |
| 2-(3-Hydroxy-2-quinolyl)-1,3-indandione | (yellow) |
| 2-(4-Bromo-3-hydroxy-2-quinolyl)-1,3-indandione | (yellow) |

TABLE 3

| | | |
|---|---|---|
| 1. | 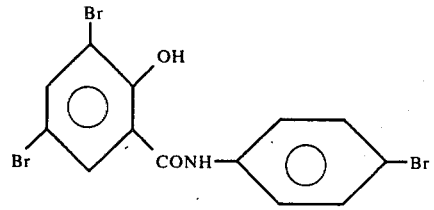 | Bacteriostat |
| 2. | 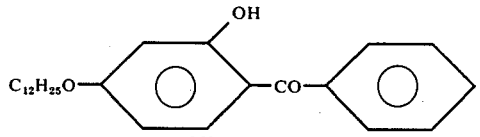 | Ultraviolet light screening agent |
| 3. | 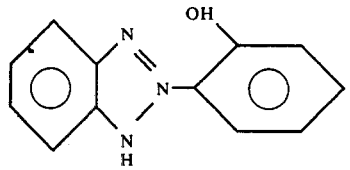 | Ultraviolet light screening agent |
| 4. | 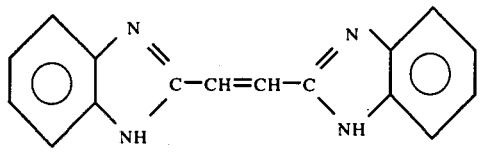 | Fluorescent brightening agent |
| 5. | 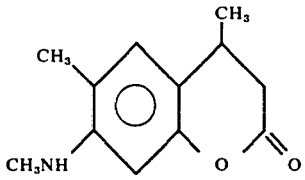 | Fluorescent brightening agent |
| 6. | 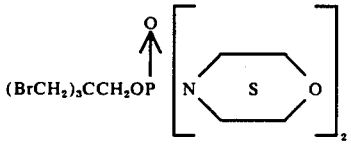 | Flameproofing agent |
| 7. | 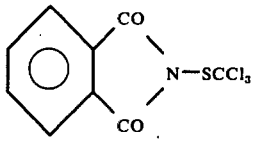 | Fungicide |
| 8. | 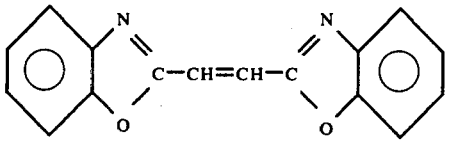 | Fluorescent brightening agent |

The evaporation of the wetting liquid from the web in seven seconds or less is achieved in the invention process by contacting the wet textile web with the superheated vapors of a liquid fluorocarbon stripping liquid having a boiling point of 20°–220° C., preferably greater than 40° C., and selected from fluoro and chlorofluoro substituted aliphatic and cycloaliphatic hydrocarbons, ethers and tert.-amines wherein the ratio of hydrogen atoms to halogen atoms is 0–0.2. Contact of the wet textile web with the superheated vapors of the stripping liquid is done under conditions, discussed hereinafter, which are such that heat supplied from the superheat of the vapors is transferred to the wetting liquid, in the substantial absence of noncondensable gases, to vaporize the wetting liquid without substantial condensation of the vapors on the web. Noncondensable gases are gases, such as air, which cannot be condensed in a cold water condenser at a temperature of about 20° C.

In addition to their being useful wetting liquids, liquids 1–17 in Table 1 are also useful stripping liquids herein. Other useful stripping liquids include liquids which have boiling points of up to 220° C. and which are of the same chemical classes as the liquids included in Table 1. Also useful are fluorocarbon mixtures, such as perfluorokerosene. Although it is generally preferred that the stripping liquid and the wetting liquid be the same, they need not be. When the stripping liquid is not the same as the wetting liquid, it is preferred that the boiling point of the former be at least about 100° C. above the boiling point of the latter to facilitate subsequent distillative separation and recovery thereof. Use of a high boiling stripping liquid which is different from the wetting liquid may be preferred when evaporation of the wetting liquid is combined with a subsequent textile web processing step which requires a high temperature (discussed more fully hereinafter). Examples of relatively high boiling point stripping liquids are listed in Table 4.

TABLE 4

| No. | Stripping Liquids | b.p. (° C.) | Hv (cal./gram) |
|---|---|---|---|
| | $F[CF(CF_3)CF_2O]_nCHFCF_3$ | | |
| 1 | wherein n = 3 | 152 | 14 |
| 2 | 4 | 194 | 12 |
| 3 | 5 | 218 | 10 |
| | $F[CF(CF_3)CF_2O]_nCF_2CF_3$ | | |
| 4 | wherein n = 3 | 152 | 14 |
| 5 | 4 | 194 | 12 |
| 6 | 5 | 218 | 10 |
| 7 | Perfluoro(1-methyldecalin) | 160 | 17 |
| 8 | Perfluoro(tributylamine) | 180 | 14 |
| 9 | Perfluoroundecane | 161 | 15 |
| 10 | 1-Chlorononadecafluorononane | 150 | 17 |
| 11 | 1-Chloro-9H-octadecafluorononane | 162 | 18 |
| 12 | 1H-Heptadecafluorooctane | 120 | 19 |

As already indicated, the invention process transfers sufficient heat to the wetting liquid (and to the web and to any additives thereon) to achieve vaporization of substantially all the wetting liquid from the web within seven seconds, and preferably within three seconds, with no substantial migration of textile agent on the web. The temperature of the superheated vapors of stripping liquid generally must be kept below that at which permanent alteration or damage to the textile can occur. This limiting temperature is dependent on the chemical composition of the textile. For example, consideration must be given to the transition temperature (Tg) of textiles comprising such synthetic polymers as polyesters, polyamides and polyacrylics, including modacrylics, since at and above the Tg dimensional changes in the polymer may occur and the orientation of the web may be altered. Such dimensional changes may be desirable and are normally used to advantage in the textile industry to heat-set the web, that is, to orient and stabilize the textile web in the form desired for its particular end use. Since minimum dimensional change in the textile web is most often desired in connection with the application of textile agents, the temperature of the textile web usually is maintained below the Tg of such an aforesaid synthetic polymer comprising it. Vaporization of the wetting liquid by the superheated vapors of the stripping liquid initially limits the temperature of the textile web to a maximum of about the ambient boiling point of the wetting liquid on the web. After vaporization of the wetting liquid is completed, however, the temperature of the textile web rapidly approaches the temperature of the superheated stripping liquid vapor. Therefore, when heatsetting or other thermal processing of the web is undesirable, the total heat applied to the textile web is controlled so that only vaporization of the wetting liquid occurs. When heatsetting or other thermal processing is not desired, heating of the textile web substantially beyond that necessary for removal of the wetting liquid is to be avoided since it constitutes a waste of energy. Control of the quantity of heat applied can be achieved by use of well-known methods, such as by controlling contact time, flow rate of the superheated vapor of the stripping liquid and direction of the vapor flow; for example, in drying a polymeric web whose Tg is not to be substantially exceeded, superheated vapor whose temperature is above the Tg may flow cocurrent with the web so that the superheated vapor, at its highest temperature, contacts that part of the web which is wet with wetting liquid. A preferred and simpler method for controlling the heat applied to the web, however, is by employing: (a) a wetting liquid having a boiling point of no more than 50° C.; (b) a superheated stripping liquid vapor temperature which is not substantially above the Tg of the polymer comprising the textile web; or (c) a combination of (a) and (b) wherein the wetting liquid and the stripping liquid are the same. Generally, these preferred conditions permit the temperature of the superheated stripping liquid vapor to be 50°–100° C. above the boiling point of the wetting liquid.

Although most textile agents do not migrate when drying times up to about seven seconds are employed in the process of this invention, it is preferred to evaporate the wetting liquid from the web in no more than 3 seconds to ensure migration-free drying with any agent. For example, wetting liquids containing heavy shades of dyes are generally more difficult to dry in an even or level manner than are wetting liquids containing light shades of dyes. Satisfactory drying of wetting liquids containing heavy shades of dyes, therefore, may require evaporation of the wetting liquid in no more than three seconds.

The heat flux, that is, the amount of heat applied to the web in a given time, which is needed to effect drying depends on process conditions, such as the nature of the liquid and the liquid loading level of the web. The term "heat flux" is a generally accepted art term which describes the rate of heat transfer to the wet web in heat units of calories per area of web (in square centimeters) per second of time. The heat flux for most situations is within the range 0.1–5 cal./cm.$^2$/sec.

The invention process is a drying process which avoids migration of the textile agent and which, under preferred conditions, provides for simple process control and avoids permanent textile web modifications. As already indicated above, it is possible and sometimes advantageous to combine the invention process with a conventional heat treatment process, such as heatsetting, dye fixation or textile finish curing. Most such processes require temperatures which are higher than those normally needed for evaporation of a fluorocarbon wetting liquid. Combination of such a process with the drying process may require upward adjustment of the superheated stripping liquid vapor temperature and/or the contact time of the textile web and the stripping liquid vapors. For example, in a continuous process, a fabric which is woven from yarn of polyethylene terephthalate and which is wet with a dispersion of a disperse dye in trichlorofluoromethane (b.p. 24° C.) can be dried and the dye fixed therein (with no substantial dye migration) to give a level dyeing in less than seven seconds contact with the superheated vapor of perfluoro(tributylamine) at 190° C. When combining evaporation of the wetting liquid with another heating process, the temperature of the superheated stripping liquid vapor preferably should be at least about 100° C. above the boiling point of the wetting liquid. Even more preferred is a superheated vapor temperature of 100°–220° C. above the boiling point of the wetting liquid.

When textile webs comprising thermoplastic synthetic polymers, such as polyesters, polyamides or polyacrylics, are used in the invention process at temperatures near or appreciably above their Tg, they must be handled as normally done in the art at such temperatures; that is, means must be provided to maintain proper web orientation in order to preclude deterioration in textile properties. For example, knit fabrics should generally be moved through the zone of contact with the superheated stripping liquid vapor under conditions such that tension on the fabric is avoided in order to maintain desirable tactile esthetics. At superheated vapor temperatures below the Tg of the polymers comprising the textile web, ordinary art methods for handling the textile web are adequate. Art means can be used to achieve good heat exchange between the moving wet textile web and the superheated vapor of the stripping liquid. For example, the superheated vapor can be staged so that all exposed textile web is subjected to approximately the same vapor temperature. Known gas distribution devices, such as plenum arrangements or perforated drums, can be used for this purpose. It is possible to carry out the process of the invention by simply passing the web through a substantially quiescent zone of superheated stripping liquid vapors. Such a mode of operation is advisable only with stripping liquids having high heat transfer efficiency, such as a liquid of Table 4. With suitably superheated vapors of such stripping liquids, mechanical means, such as a pump or fan, for providing vapor circulation can be avoided. However, best heat transfer is realized if the superheated vapors are in forced flow contact with the textile web, preferably against both sides and through the web. Under the latter conditions, heat transfer coefficients of at least 0.025 cal./cm.$^2$/sec./° C. can be realized. As used herein, the term "heat transfer coefficient" is the total heat flow (in calories) divided by the product of the exposed web area (in square centimeters) and the average temperature difference (in ° C.) between the superheated stripping liquid vapor and the boiling point of the wetting liquid.

The bulk of the vapors of the wetting liquid and stripping liquid are recovered by condensation, normally with a water-cooled condenser. For this reason, neither liquid should have a boiling point of less than about 20° C. The vapors within the web can be recovered by means of a dry steam sweep of the web, followed by condensation and decantation separation of the liquids from the water.

EXAMPLES 1–5

These examples demonstrate migration-free drying under various conditions according to the invention. The data for these examples which are summarized in Table 5 are prospective data since the examples were not actually carried out.

TABLE 5

| Ex. | Web Polymer | Web* Weight (g./meter$^2$) | Wetting Liquid | Wetting Liquid Loading (wt. %) | Stripping Liquid | Web Velocity (meters/sec.) | Length of Dryer (meters) | Drying Time (sec.) | Stripping Liquid Vapor Temp. (° C.) In | Out | Flow Rate (g./sec.) | Heat Flux to Web (cal./cm.$^2$/sec.) |
|---|---|---|---|---|---|---|---|---|---|---|---|---|
| 1 | polyethylene terephthalate | 190 | 1,1,2-trichloro-1,2,2-trifluoro-ethane | 150 | 1,1,2-trichloro-1,2,2-trifluoro-ethane | 0.46 | 0.48 | 1.0 | 140 | 56 | 456 | 1.3 |
| 2 | nylon 66 | 284 | trichloro-fluoro-methane | 160 | 1,1,2-trichloro-1,2,2 trifluoro-ethane | 0.30 | 0.31 | 1.0 | 150 | 58 | 430 | 2.0 |
| 3 | nylon 66 | 948 | 1,1,2-trichloro-1,2,2-trifluoro-ethane | 95 | $F[CF(CF_3)CF_2O]_4CHFCF_3$ | 0.06 | 0.07 | 1.2 | 230 | 196 | 485 | 3.9 |
| 4 | cellulose triacetate | 237 | trichloro-fluoro-methane | 200 | trichloro-fluoro-methane | 0.76 | 2.2 | 2.9 | 70 | 38 | 3708 | 0.74 |
| 5 | cellulose triacetate | 237 | trichloro-fluoro-methane | 200 | trichloro-fluoro-methane | 0.76 | 3.9 | 5.1 | 56 | 26 | 3955 | 0.42 |

*Web width = 1 meter

EXAMPLE 6

This example demonstrates a combination of migration-free drying of polyester fabric which is padded with a dye dispersion and subsequent fixing of the dye using the stripping liquid vapors for both drying and fixing. A 15.2 cm. wide web of 248 g./meter$^2$ double-knit polyethylene terephthalate fabric was passed at 1.8 meters/min. through a 1-nip, 2-roll padder containing a dispersion of 2-(3-hydroxy-2-quinolyl)-1,3-indandione (a yellow disperse dye) in 1,1,2-trichloro-1,2,2-trifluoroethane. The liquid loading of the fabric was about 160 wt. percent. On leaving the padder, the fabric passed downwardly into the vapors of $F[CF(CF_3)CF_2O]_4CHFCF_3$ superheated to 194°–204° C. After short passage through the vapors, the fabric passed under a roller and then upwardly out of the vapor zone. The fabric was estimated to have dried in about 1.2 cm. travel distance in the vapors. This corresponds to about a 0.41 second calculated drying time. The heat flux to the fabric during this period was calculated to be about 3.8 cal./cm.$^2$/sec. After drying, the temperature of the fabric rose during additional travel through the vapors and the dye was fixed on the fabric. The yellow fabric was seen, on examination, to be dyed levelly.

The above experiment was repeated except that the freshly padded fabric was passed at 1.4 meters/min. through a quiescent-air dryer 1.6 cm. high × 18 cm. wide × 102 cm. long. The temperature at the inlet was 38° C. and at the outlet was 112° C. The fabric, which emerged dry, was thereafter thermally fixed in a separate step. The fabric was observed to be unevenly dyed due to migration of the dye. Drying was estimated to have occurred within about the first 61 cm. of the dryer. This corresponds to a calculated drying time of about 27 seconds. The heat flux to the fabric was calculated to be about 0.059 cal./cm.$^2$/sec. These parameters place this experiment outside the invention.

EXAMPLE 7

Example 6 was repeated except that the padded fabric was passed at 0.91 meter/min. through the dryer of the second experiment of Example 6. Superheated vapors of 1,1,2-trichloro-1,2,2-trifluoroethane were circulated through the dryer, in the direction countercurrent to the fabric direction, at the rate of 0.91 kg./min. The temperature of the vapor on entering the dryer was 133° C. and 92° C. on leaving. The fabric left the dryer in the dry state. On fixing by art methods, the fabric was seen to be levelly dyed. Drying was estimated to have occurred over a 10 cm. travel distance. This corresponds to a calculated drying time of about 6.6 seconds and a calculated heat flux to the fabric of about 0.21 cal./cm.$^2$/sec. The parameters of this example fall within the invention.

EXAMPLE 8

Shown below are calculated data which reflect the magnitudes of throughput, in terms of kg./meter$^2$/hour, which can be achieved in the drying of textile fabrics of various weights by means of this invention process.

a. 240 g./m.$^2$ fabric ("Average" fabric)
   150 wt. percent liquor load
   drying in 5 sec. corresponds to 366 kg./meter$^2$/hour drying rate.
b. 1,300 g./m.$^2$ fabric (heavy fabric)
   250 wt. percent liquor load
   drying in 5 sec. corresponds to 3,358 kg./meter$^2$/hour drying rate.
c. 50 g./m.$^2$ fabric (light fabric)
   40 wt. percent liquor load
   drying in 7 sec. corresponds to 14 kg./meter$^2$/hour drying rate.

I claim:

1. Textile drying process comprising continuously contacting a moving textile web, which is wet with a first fluorocarbon liquid having a textile agent dispersed therein, said agent being a dye, a bacteriostatic agent, an ultraviolet light screening agent, a fluorescent brightening agent, a fire retardant agent, an antistatic agent, a pigment, a water repellent, a fungicide, a soil release agent or a permanent-press agent, with the superheated vapors of a second fluorocarbon liquid, the superheated vapors being at a temperature such that no substantial amount of second fluorocarbon liquid condenses on the web, to evaporate substantially all of the first fluorocarbon liquid from the web in no more than seven seconds without causing substantial migration of the textile agent on the web, said first and second fluorocarbon liquids being the same or different and selected from fluoro and chlorofluoro substituted aliphatic and cycloaliphatic hydrocarbons, ethers and tert.-amines wherein the ratio of hydrogen atoms to halogen atoms is 0–0.2, the first fluorocarbon liquid having a boiling point of 20°–110° C. and the second fluorocarbon liquid having a boiling point of 20°–220° C.

2. Process of claim 1 wherein the first fluorocarbon liquid is evaporated in no more than three seconds.

3. Process of claim 1 wherein the first fluorocarbon liquid has a boiling point of 20°–50° C.

4. Process of claim 1 wherein the first and second fluorocarbon liquids are the same.

5. Process of claim 4 wherein the first fluorocarbon liquid is evaporated in no more than three seconds.

6. Process of claim 1 wherein the heat flux to the fabric is 0.1–5 cal./cm.$^2$/sec.

7. Process of claim 1 wherein the temperature of the superheated second fluorocarbon liquid vapor is 100°–220° C. above the boiling point of the first fluorocarbon liquid.

8. Process of claim 1 wherein the first fluorocarbon liquid is trichlorofluoromethane or 1,1,2-trichloro-1,2,2-trifluoroethane.

9. Process of claim 4 wherein the first fluorocarbon liquid is trichlorofluoromethane or 1,1,2-trichloro-1,2,2-trifluoroethane.

10. Process of claim 1 wherein the first and second fluorocarbon liquids are different.

11. Process of claim 10 wherein the second fluorocarbon liquid has a boiling point at least about 100° C. higher than the boiling point of the first fluorocarbon liquid.

12. Process of claim 10 wherein the first fluorocarbon liquid is trichlorofluoromethane or 1,1,2-trichloro-1,2,2-trifluoroethane and the second fluorocarbon liquid has a boiling point at least about 100° C. above the boiling point of the first fluorocarbon liquid.

13. The process of claim 11 wherein the first fluorocarbon liquid is trichlorofluoromethane or 1,1,2-trichloro-1,2,2-trifluoroethane and the second fluorocarbon liquid is $F[CF(CF_3)CF_2O]_4CHFCF_3$.

14. Process of claim 1 wherein the textile agent is a dye, a bacteriostatic agent, an ultraviolet light screening agent, a fluorescent brightening agent, a fire retardant agent, an antistatic agent, a pigment, a water repellent, a fungicide, a soil release agent or a permanent-press agent.

15. Process of claim 1 wherein the textile agent is a dye.

16. Process of claim 1 wherein the dye is a disperse dye.

17. Process of claim 1 wherein the textile web is a fabric or carpet.

18. Process of claim 1 wherein the textile web is comprised of polyester, polyamide or polyacrylic fibers.

19. Process of claim 6 wherein the first fluorocarbon liquid is trichlorofluoromethane or 1,1,2-trichloro-1,2,2-trifluoroethane.

* * * * *

UNITED STATES PATENT OFFICE

CERTIFICATE OF CORRECTION

PATENT NO. : 3,992,144

DATED : November 16, 1976

INVENTOR(S) : Harold L. Jackson

It is certified that error appears in the above-identified patent and that said Letters Patent are hereby corrected as shown below:

Column 12, lines 46-51, delete Claim 14.

Column 12, line 52, change "15" to -- 14 --.

Column 12, line 54, change "16" to -- 15 --.

Column 12, line 56, change "17" to -- 16 --.

Column 12, line 58, change "18" to -- 17 --.

Column 12, line 61, change "19" to -- 18 --.

Signed and Sealed this

Seventeenth Day of May 1977

[SEAL]

*Attest:*

RUTH C. MASON
*Attesting Officer*

C. MARSHALL DANN
*Commissioner of Patents and Trademarks*